United States Patent [19]

Singer

[11] 4,165,056

[45] Aug. 21, 1979

[54] STRAND TENSIONING DEVICE AND METHOD

[76] Inventor: Hans S. Singer, 191 Inglewood, Greenville, S.C. 29609

[21] Appl. No.: 894,167

[22] Filed: Apr. 6, 1978

[51] Int. Cl.[2] ..... B65H 59/24; B65H 59/30

[52] U.S. Cl. ..... 242/151; 242/147 M; 242/154

[58] Field of Search ..... 242/151, 152, 152.1, 242/149, 147 R, 147 M, 153, 154, 129.8, 45, 75.2, 75.3, 131, 131.1

[56] References Cited

U.S. PATENT DOCUMENTS

| | | | |
|---|---|---|---|
| 739,523 | 9/1903 | Wells | 242/151 |
| 1,040,185 | 10/1912 | Gerstberger | 242/152.1 |
| 1,055,108 | 3/1913 | Wells | 242/151 X |
| 1,211,862 | 1/1917 | Lister | 2 42/152.1 X |
| 1,313,919 | 8/1919 | Sawtell | 242/151 X |
| 1,372,557 | 3/1921 | Sawtell | 242/152.1 |
| 1,618,699 | 2/1927 | Davis | 242/151 |
| 1,620,571 | 3/1927 | Rhoades et al. | 242/151 |
| 1,825,626 | 9/1931 | Bock | 242/151 |

FOREIGN PATENT DOCUMENTS

| | | | |
|---|---|---|---|
| 382322 | 10/1923 | Fed. Rep. of Germany | 242/151 |
| 717844 | 10/1931 | France | 242/152.1 |
| 3487 | of 1914 | United Kingdom | 242/152.1 |
| 126805 | 5/1919 | United Kingdom | 242/151 |
| 299620 | 11/1928 | United Kingdom | 242/152.1 |

*Primary Examiner*—Stanley N. Gilreath
*Attorney, Agent, or Firm*—Bailey, Dority & Flint

[57] ABSTRACT

A tensioning device is illustrated wherein a plurality of longitudinally aligned upright receptacles carry stacked rollers the lowermost of which is driven by the passage of yarn thereunder. A vertical yarn passageway is carried in at least one end of the housing forming an end receptacle to permit a change of direction in the yarn to cause up and down roller movement to compensate for changes in tension in the yarn as well as alternate yarn paths. Passageways are provided in the housing adjacent the pairs of rollers so as to permit expulsion of lint from the receptacles which is promoted by turning of the rolls. Magnetic means may be carried beneath the device for varying the force exerted by the rollers on the strand and the magnetic means may be varied for this purpose. Detector means such as photo-electric devices may be utilized for detecting variation in the turning of the rollers to act as a stop motion for the machine utilizing the tensioning device. By aligning and accommodating rollers in spaced end-to-end relation a number of aligned strands may be handled conveniently in a tension device having a single or modular housing.

15 Claims, 7 Drawing Figures

STRAND TENSIONING DEVICE AND METHOD

BACKGROUND OF THE INVENTION

This is an improvement relating to the subject matter of co-pending application Ser. No. 664,689, filed Mar. 8, 1976 entitled YARN TENSION DEVICE, now U.S. Pat. No. 4,095,757 the disclosure of which is incorporated herein and made a part hereof by reference. An improved feature contemplates the provision of compensator means to permit a change of direction in the yarn to cause roller movement up and down within a receptacle to compensate for changes in tension in the yarn. Improvement further contemplates the provision of means for removing lint automatically during the operation of the device to avoid variations in tension produced by the rolls and clogging thereof within the at least partially enclosed receptacles. A further improvement contemplates the use of a yarn tension device provided in the form of magnetic means which may vary the force applied by roller means upon the yarn or rather stated another way, the force required to produce rotation of the rollers by the yarn. Rotation of the rollers by the yarn successively in the stack of rollers is an important feature sometimes utilized by the improvement herein as well as the patent application referred to above. Photoelectric detector means may be provided for detecting a variation in speed of any of the rollers to actuate or provide a portion of stop motion to control the operation of the machine utilizing the tension device. Other improvements contemplate variations in yarn path and variations accommodating multiple strands.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
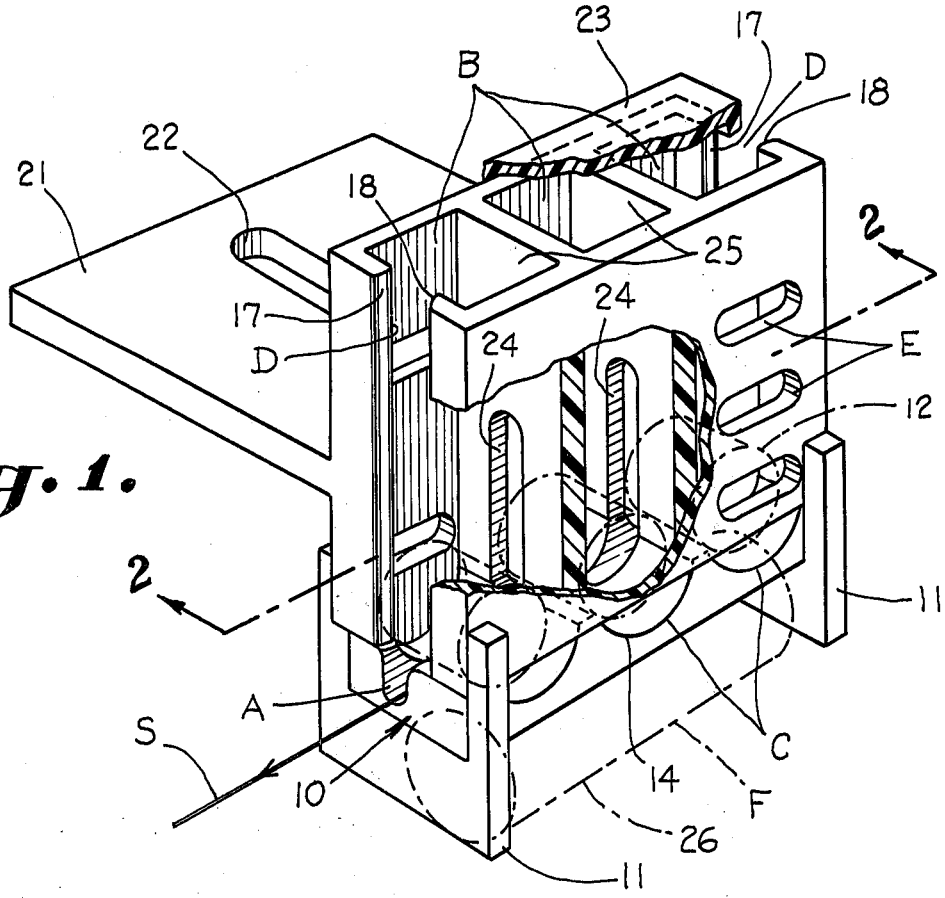
FIG. 1 is a perspective view illustrating a tension device constructed in accordance with the present invention as well as the method contemplated thereby.

The drawing illustrates a yarn tension device utilizing rollers comprising a housing having an elongated yarn passageway A therein. A plurality of spaced longitudinally aligned upright receptacles B are formed in the housing and open into yarn passageway for carrying the rollers in stacked relation therein. Means C are provided for positioning the rollers in rotating engagement with the yarn at spaced positions along the yarn passageway. A vertical yarn passageway D is carried in at least one end of the housing opening the elongated yarn passageway permitting a change in direction of the yarn to cause compensating roller movement to compensate for changes in tension in the yarn. A vertical partition is provided in the housing separating or defining each of the receptacles, and the housing has a passageway means E in a side of the housing opposite each pair of rollers carried therein. The method of tensioning the moving strand contemplates changing the direction of the yarn adjacent a roller in engagement with the yarn so as to cause the engaged roller to compensate for changes in tension by moving up and down responsive thereto. The yarn tension device further contemplates carrying elongated magnetic means F below the device for varying the downward force exerted by the rollers. Photoelectric detector means G and the like may be provided for stopping a machine utilizing the tension when the strand comes down responsive to change in roller speed.

The yarn passageways D permit a variety of yarn paths including multiple reverse paths between rows of rolls. The yarn passageways also avoid binding contact with the strand in the other applications, such as the several compensator applications disclosed herein. A modified form of the invention is also provided for handling multiple adjacent strands wherein transverse yarn paths under the rollers are provided.

The elongated yarn passageway A is formed in a base member which is broadly designated at 10. The base member is preferably constructed of wear-resistent material as described in the disclosure referred to above. Much of the description herein relates to the basic elements described in the aforesaid disclosure. The base member 10 is carried between side members 11 which are illustrated as being secured to the housing which carries the receptacles B which open onto the base member 10. Special hollow stacked rollers are designated at 12 and include an opening 13 to provide a roller of selected weight. Additional rollers will be described below and variations specified by particular reference characters in connection with each roller. The rollers such as the follow roller illustrated at 12 having the cylindrical longitudinal opening 13 therein may be stacked in horizontal rows or tiers and within respective receptacles as will be described below. By making rollers having various sized openings 13 various combinations of roll weights may be selected to provide a predetermined tension.

The means C are provided so as to include concave arcuate portions which are designated at 14. The channel of the passageway A enters into the arcuate recess 14 and provides channel walls 15 together with an intermediate portion 16 upon which the bearing force of the lowermost roller may engage the yarn or strand which is illustrated at S in the drawings. A vertical yarn passageway D is defined by spaced walls 17 and 18 (FIG. 1) in the housing and is preferably provided at each end receptacle B as illustrated in the drawings. As best illustrated in FIG. 2, an end roller which is illustrated in this instance as being solid at 19 is permitted to move up and down from solid to broken line position so that the tension is compensated for by variation in the direction of movement of the strands. Any suitable switch, schematically designated at 20 may be utilized to actuate control or stop motion mechanism of any desired type should variation in yard tension become excessive.

Figure 5:
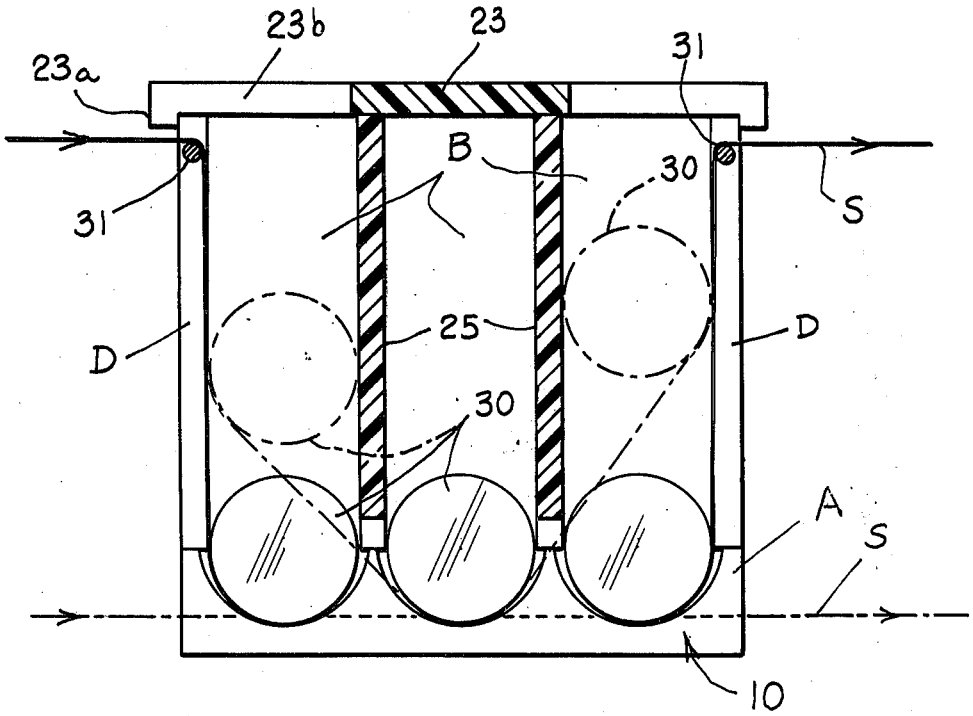
FIG. 5 is a longitudinal sectional elevation similar to FIG. 2 illustrating a modified form of compensator.

A bracket 21 which projects horizontally rearwardly from an intermediate portion of a housing may be of integral plastic construction with the housing. An elongated slot 22 may be provided to permit adjustable connection upon multiple machines such as for example, spinning, twisting or knitting equipment. A cover 23 may be provided having depending marginal portions 23*a* which may be snapped about the upper portion of the housing covering the compartments B but not interfering with yarn movement, as best illustrated in FIG. 5 wherein longitudinal slots 23*b* may be provided overlying each of the end receptacles B so that the cover 23 is substantially H-shaped. The cover slots 23*b* thus are aligned with and from a front of the vertical passageways D for accommodating the yarn.

Figure 3:
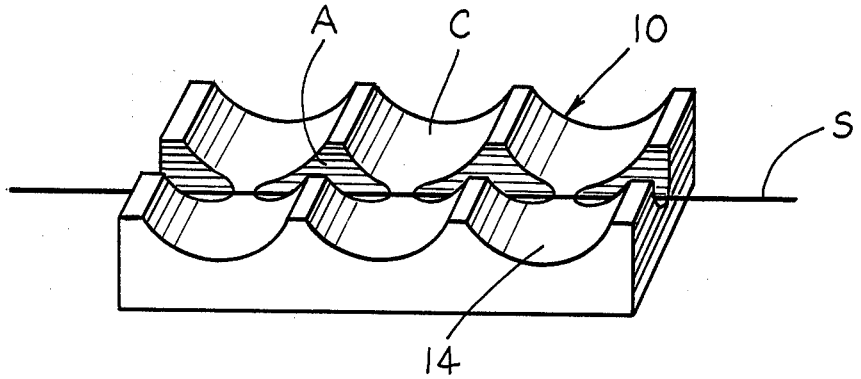
FIG. 3 is a perspective view of a roller support or base member constructed in accordance with the invention.

As best illustrated in FIG. 3, a base 10 is provided with a yarn channel A which also has arcuate portions included in means C transverse thereto which are slightly larger than the rollers. An intermediate portion is thus formed between passageway portions A separated by the arcuate portions 14 for supporting the rollers causing the strand to wrap about the rollers sufficiently to rotate the lowermost and successively stacked rollers.

Figure 4:
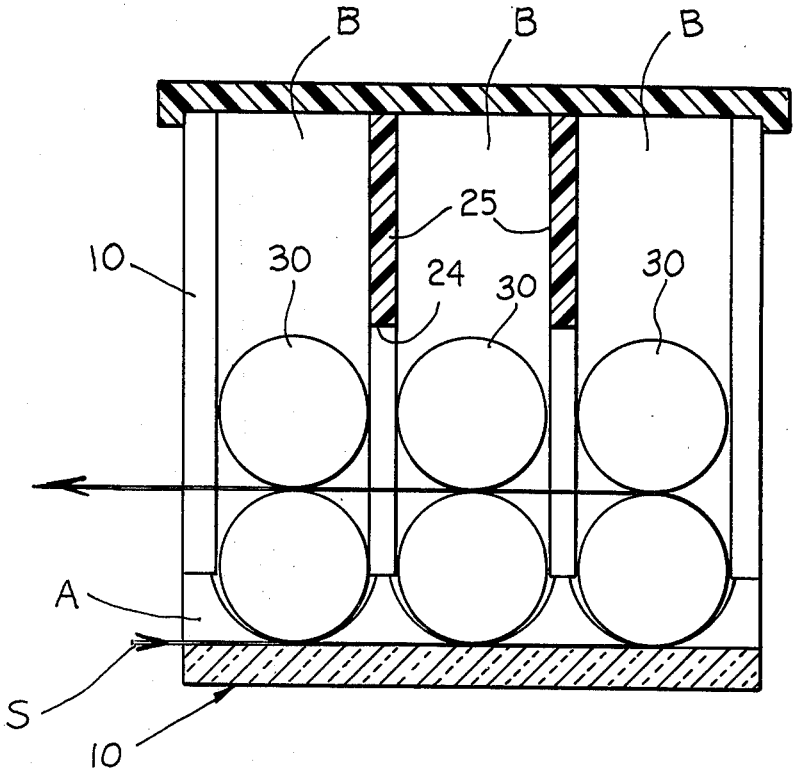
FIG. 4 is a longitudinal sectional elevation similar to FIG. 2 with parts omitted, illustrating a variation in yarn path.

As illustrated in FIGS. 1 through 4, vertical slots are provided in the partitions 25 which form the receptacles B and are so provided as not to interfere with the traverse of the strand when the end rollers are acting as compensators or when the yarn is assuming a path as described herein. It is important to note that passageways illustrated at E are provided in the form of slots affording passageway means opposite contacting portions of the stacked rollers for emitting lint collected by the rollers within the housing. An alternate pathway for the strand is illustrated in FIG. 4 wherein the strand passing under a first tier or rollers and then back in a reverse direction above the first tier of rollers, and beneath a second tier of rollers as best illustrated in FIG. 4. The alternate pathway includes the vertical slots 24 which also accommodate the pathway for use with the end compensator rolls.

Figure 2:
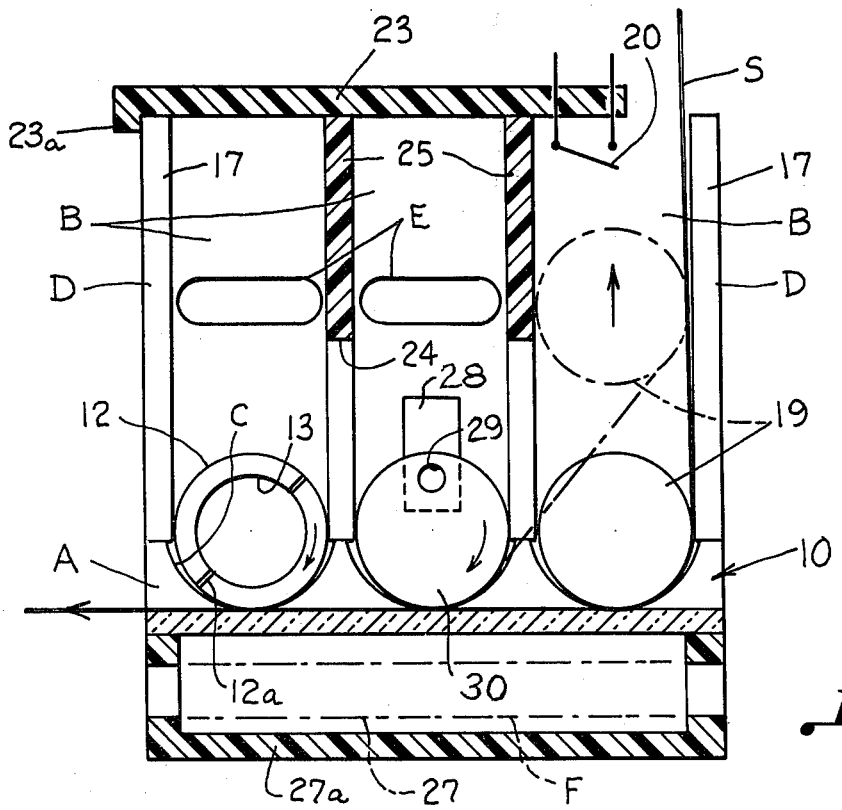
FIG. 2 is a longitudinal sectional elevation taken on the line 2—2 in FIG. 1 illustrating a form of compensator.

The drawings further illustrate the use of elongated magnetic means F illustrated in FIG. 1 as a permanent magnet 26 which may be adjustably positioned vertically as by pressed fit between the depending portions of members 11 carried by the housing to provide an adjustable magnetic force upon the rollers. FIG. 2 illustrates a slightly modified form of an electromagnet 27, carried in a bracket 27*a*, which may be provided with electrical energy in varying amounts so as to make the force exerted thereby upon the rollers adjustable. It will be noted that a mark 12*a* may be carried for utilizing suitable equipment for monitoring roller speed and continuity of action. Whether or not the roll is turning may be visually determined.

FIG. 2 best illustrates the use of a photoelectric detector means G which includes a detector designated at 28, suitably carried by the housing, and an opening 29 carried in the roller 30 for acting as a stop motion should the roller discontinue turning as a result of engagement by the yard indicating a loss of tension of breakage of the strand. Detection may also be accomplished by sensing action of the etched or otherwise placed end markings as exemplified at 12*a* in roller 12.

FIG. 5 illustrates a modified form of the invention wherein each end roller receptacle acts as part of the compensating means. The strand S is illustrated as passing over a pin 31 which bridges an upper portion of the vertical yarn passageways D. The vertical yarn passageway, as well as the slots 23*b* in the cover, avoid pinching of the yarn on the strand between the roller and a wall surface or in fact, any interference with the accommodation of the strand for passage in a desirable pathway, such as illustrated in FIG. 5. Passageways are provided beneath the partitions 25 such as illustrated at 24 in FIG. 2, for further accommodating the yarn path as well as permitting reverse passage of the yarn of strand between successive tiers of rollers as best illustrated in FIG. 4. It will be noted, that each of the rollers 30 in the end receptacle B of FIG. 5, may be raised and lowered to perform a compensating function. The yarn passageway D bridged by the pin 31 facilitates the passage of the yarn in a suitable pathway.

Figure 6:
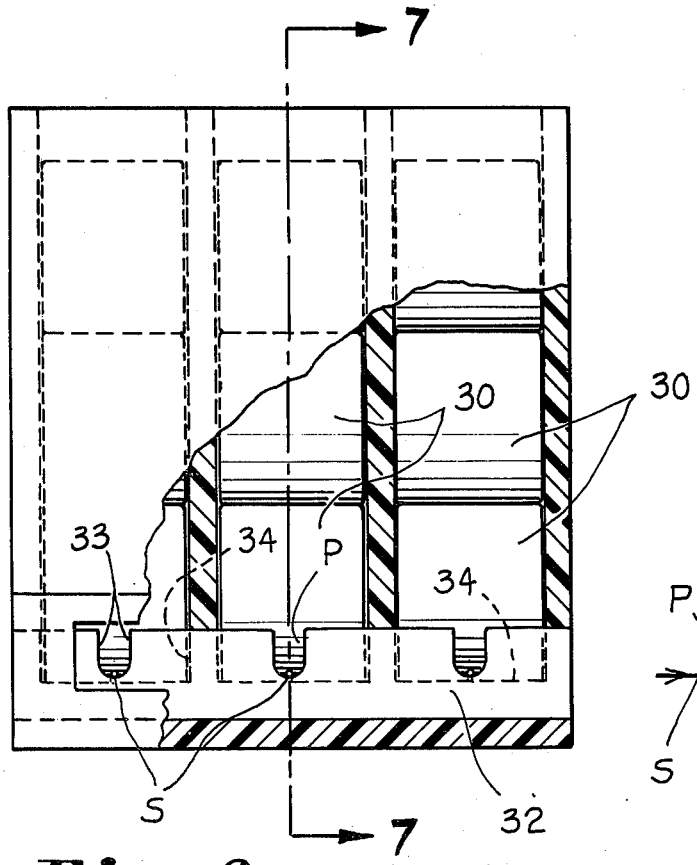
FIG. 6 is a side elevation illustrating a tension for multiple strands constructed in accordance with a modified form of the invention.
Figure 7:
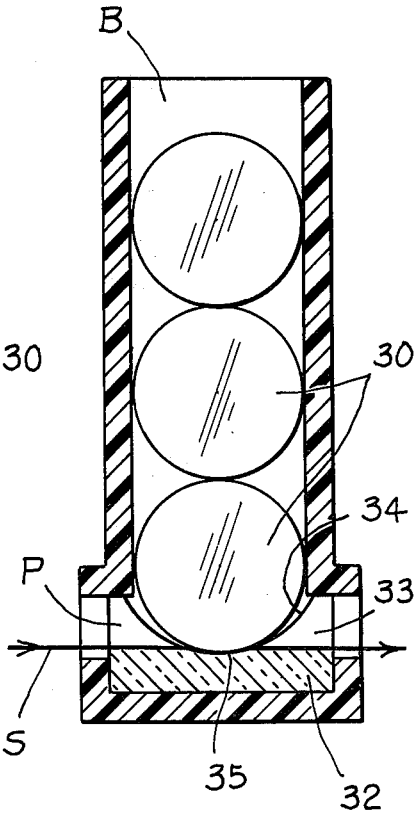
FIG. 7 is a transverse sectional elevation further illustrating the modification of FIG. 6.

Referring now to FIGS. 6 and 7, a further modified form of the invention is illustrated wherein a housing containing receptacles B is configured so as to accommodate multiple strands which pass transversely rather than longitudinally of the tension device. The rollers 30 are of such dimension so that their axis is disposed longitudinally and cannot be positioned within the receptacles B with the axis in a transverse position with respect to the housing as heretofore accommodated in the housings hereof. The base member 10 is modified as illustrated at 32 in FIGS. 6 and 7 wherein the walls 33 define a transverse channel P rather than a longitudinal channel A as heretofore discussed. The arcuate portions 14 have corresponding arcuate portions 34 which are disposed longitudinally of the base member 32 and define an intermediate portion 35 between spaced portions of the yarn channel P defined by the arcuate portion 34 extending below the yarn channel P. In this fashion, multiple strands may be accommodated as would be useful in connection with sewing machines and the like. Thus, the elongated base members 32 have transverse walls 33 defining yarn channels P. A plurality of longitudinal, concave, arcuate surfaces 34 are carried in end-to-end spaced relation defining indentations in the base member extending across and below the channels as at 35. The cylindrical surfaces 34 correspond generally but are slightly smaller than the rollers as is the case with the base members 10 referred to above. The arcuate interruption 35 is of sufficient extent to cause the strand to produce rotation of the lower roller 30.

While a preferred embodiment of the invention has been described using specific terms, such description is for illustrative purposes only, and it is to be understood that changes and variations may be made without departing from the spirit or scope of the following claims.

What is claimed is:

1. A yarn tension device utilizing rollers comprising:

a housing;

an elongated yarn passageway within said housing;

a plurality of spaced longitudinally aligned upright receptacles in said housing opening into said yarn passageway for carrying said rollers in stacked relation therein;

means for positioning said rollers in rotating engagement with said yarn at spaced positions along said yarn passageway; and a vertical yarn passageway carried in at least one end of said housing opening into said elongated yarn passageway permitting a change in direction of the yarn to cause roller movement to compensate for changes in tension in the yarn.

2. The structure set forth in claim 1 including a vertical partition in said housing separating each of said receptacles.

3. The structure set forth in claim 1 wherein one of said vertical yarn passageways is carried at each end of said housing.

4. The structure set forth in claim 2 including vertical slot means in said partition to permit yarn to be passed back over lower rollers.

5. The structure set forth in claim 1 including a transverse yarn guide carried by said housing across an upper portion of said vertical passageway.

6. The structure set forth in claim 1 including a top cover having end slots complimentary to the vertical passageway.

7. The structure set forth in claim 1 including rollers having openings therein to provide various weight combinations.

8. The structure set forth in claim 1 including visual marking means on end portions of a said roller.

9. A yarn tension device utilizing arcuate rotatable elements comprising:

a housing having a pair of opposed vertical sides;

an elongated yarn passageway within said housing;

a plurality of spaced longitudinally aligned upright receptacles in said housing formed in part by said sides opening into said yarn passageway for carrying a plurality of said arcuate rotatable elements in stacked relation therein;

means for positioning the lowermost arcuate rotatable element in rotating engagement with said yarn at spaced positions along said yarn passageway;

said housing having passageway means in a side of said housing opposite each pair of rollers for the expulsion of lint accumulations and the like therethrough.

10. The method of tensioning a moving strand comprising:

successively rotating a plurality of stacked superposed aligned cylindrical rollers responsive to driving engagement by the strand beneath the lowermost roller applying a retarding force to movement of the yarn;

simultaneously so rotating at least one other aligned roller at a closely spaced point along the yarn; and changing the direction of the yarn adjacent a roller in engagement with said yarn so as to cause said engaged roller to compensate for changes in tension by moving up and down responsive thereto.

11. A yarn tension device comprising:

a member having walls defining an elongated yarn channel;

a concave arcuate surface defining an indentation in said member extending across and below said channel forming an arcuate interruption in said yarn channel;

a first cylindrical roller having a surface corresponding generally but being slightly smaller than said concave arcuate surface;

said arcuate interruption being of such extent as to cause the yarn moving through said yarn channel to wrap around a portion of said first cylindrical roller within said arcuate interruption sufficiently to rotate said first cylindrical roller;

a vertical housing supporting at least one additional cylindrical roller stacked above and engaging said first cylindrical roller for rotation thereby; and elongated magnetic means carried below said member varying the downward force exerted by said rollers.

12. The structure set forth in claim 11 wherein said magnetic means is an electromagnet.

13. The structure set forth in claim 11 wherein said magnetic means is a permanent magnet.

14. A yarn tension device utilizing rollers comprising:

a housing;

an elongated yarn passageway within said housing;

a plurality of spaced longitudinally aligned upright receptacles in said housing opening into said yarn passageway for carrying said rollers in stacked relation therein;

means for positioning said rollers in rotating engagement with said yarn at spaced positions along said yarn passageway; and electric means carried by said tension device detecting variation in speed and stoppage of said rollers for stopping a machine utilizing said tension.

15. A tension device for multiple adjacent strands comprising:

an elongated member having transverse walls defining a plurality of longitudinally spaced transverse open channels;

a plurality of longitudinal concave arcuate surfaces in end-to-end spaced relation defining indentations in said member extending across and below said channels forming an arcuate interruption in each yarn channel;

at least one cylindrical roller carried in each arcuate indentation longitudinally of said elongated member;

said cylindrical rollers having surfaces corresponding generally but being slightly smaller than said concave arcuate surface; and said arcuate interruption being of such extent as to cause the yarn moving through said yarn channel to wrap around a portion of the cylindrical rollers within the arcuate interruptions sufficiently to rotate said cylindrical rollers.

* * * * *